United States Patent [19]

Alten

[11] 4,156,953

[45] Jun. 5, 1979

[54] GUIDING ARRANGEMENT FOR CLOSURE BODIES, ESPECIALLY ROLLER DOORS, ROLLER GATES, AND SHUTTERS

[76] Inventor: Kurt Alten, Ringstr. 14, 3015 Wennigsen, Fed. Rep. of Germany

[21] Appl. No.: 877,752

[22] Filed: Feb. 14, 1978

[30] Foreign Application Priority Data

Feb. 15, 1977 [DE] Fed. Rep. of Germany ..... 2706241

[51] Int. Cl.[2] ..... E05D 13/02

[52] U.S. Cl. ..... 16/96 R; 16/106; 160/201

[58] Field of Search ..... 16/96 R, 97, 98, 99, 16/101, 105, 106, 90, 91, 87 R, 87.4 R, 87.6 R, 87.8, DIG. 1; 160/201; 49/427

[56] References Cited

U.S. PATENT DOCUMENTS

| | | | |
|---|---|---|---|
| 894,581 | 7/1908 | Bohne | 49/427 X |
| 979,302 | 12/1910 | Horner | 49/427 |
| 2,535,501 | 12/1950 | Loughridge | 16/105 |
| 2,869,955 | 1/1959 | LaRue | 160/201 X |
| 3,343,204 | 9/1967 | Ford | 16/98 X |
| 3,484,812 | 12/1969 | Holland | 16/97 X |

*Primary Examiner*—Werner H. Schroeder
*Assistant Examiner*—Moshe I. Cohen
*Attorney, Agent, or Firm*—Becker & Becker, Inc.

[57] ABSTRACT

A guiding arrangement for closure bodies such as roller doors, roller gates and shutters, which has a substantially U-shaped cross section for receiving the lateral marginal portions of the closure body by means of which an opening of a building, e.g. a garage entrance, is to be closed. The inside of the guiding arrangement is provided with one or more longitudinal grooves for displaceably receiving a roller mounting system including one or more rollers for laterally engaging and guiding the closure member.

8 Claims, 2 Drawing Figures

GUIDING ARRANGEMENT FOR CLOSURE BODIES, ESPECIALLY ROLLER DOORS, ROLLER GATES, AND SHUTTERS

The present invention relates to a guiding means for closure bodies such as roller doors, roller gates, shutters, and the like, with a substantially U-shaped cross section for receiving the rim portion of the closure body by means of which the opening of the building, of a wall or the like is covered or closed.

In order to be able in a simple and disorder-free manner to guide the closure bodies at their rim portions during the lifting and lowering of said closure bodies, a relatively large play has heretofore been required between the guiding means and the closure body, which large play, however, has considerable drawbacks. First of all, there exists the danger that the guiding means are insufficiently sealed with regard to the closure body and furthermore that as a result thereof, wind causes considerable noise in pushing the closure body back and forth in said guiding means. Another drawback inherent to too great a play is encountered when the closure body has not the necessary bending resistance. With too large a play, the closure body may for instance under the influence of mechanical forces slip out of said guiding means.

It is, therefore, an object of the present invention to improve the sliding and guiding properties of the guiding means that only a slight door play or the like, may be provided while nevertheless a safe lowering of the closure body can be effected when the closure body has a relatively light weight.

These and other objects and advantages of the invention will appear more clearly from the following specification in connection with the accompanying drawing, in which.

Figure 1:
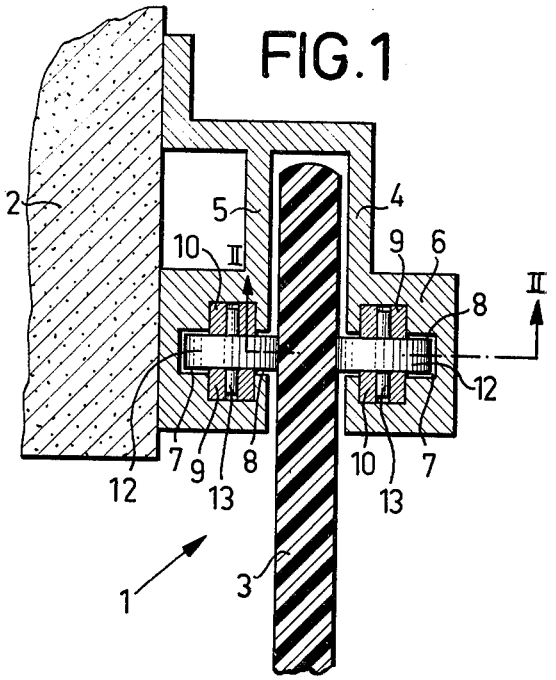
FIG. 1 represents a horizontal fragmentary section through the rim area of a roller gate.
Figure 2:
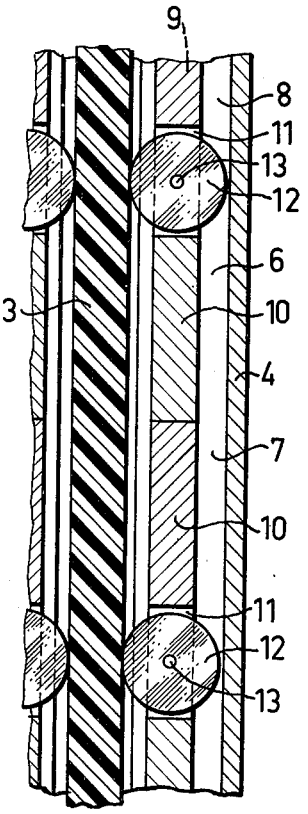
FIG. 2 is a section taken along the line II—II of FIG. 1.

The guiding means according to the present invention is characterized primarily in that the guiding means has its inner side provided with one or more longitudinal grooves for displaceably mounting a roller mount with one or more rollers for engagement with the closure body. These longitudinal grooves are preferably arranged on the inner side of the legs of the U-shaped profile of the guiding means and advantageously at oppositely located areas. Preferably these longitudinal grooves have such a cross section that the roller mounts while being displaceable in the longitudinal direction of the profile cannot drop into the space between the two profile legs.

In this way, it is possible supplementarily to provide the guiding profile in a simple manner with the above mentioned roller mounts. In such an instance it is merely necessary to introduce the roller mounts one after another from above into the pertaining groove so that eventually the grooves are over their entire length provided with roller mounts and accordingly the profile is over its entire length equipped with the mentioned rollers. Inasmuch as now within the profile, rollers are in close sequence provided for engagement with the closure body, the guiding profile hardly offers any frictional resistance during the movement of the closure body, especially during the lowering movement of the closure body.

Referring now to the drawing in detail, the building opening 1 to be closed by the roller gate, is limited by the wall 2 of the building.

The bendable closure body 3 for closing the building opening 1 which is adapted to be wound up at the upper rim portion of the building opening 1, is guided laterally and held at both rim portions by a vertical guiding means 4 which is fixedly connected to the wall 2 and has substantially a U-shaped cross section.

The two legs 5,6 of the guiding profile of guiding means 4 are increased in thickness at their free ends and have their inner side provided with a longitudinal groove 7. Groove 7 has an approximately cross-shaped cross section and more specifically a portion 8 which extends perpendicular to the legs 5,6 and furthermore has a section 9 which has its axis transverse to the portion 8 while extending through the central portion of the portion 8. The section 9 serves for receiving a bar-shaped body 10 of synthetic material or the like which at about half its length is provided with a perforation 11 for receiving a roller 12. The axle 13 of roller 12 is mounted laterally in the body 10.

The rollers 12 slightly extend into the space between the two legs 6,5 for engagement by the closure body 3 in order, in this way, to considerably reduce the friction.

The bodies 10 loosely located one upon the other have, of course, to have such a cross section that they correspond to the cross section of section 9. However, the bodies 10 are arranged in said section 9 with such a play that the bodies 10 together with their rollers 12 from above one after another can be introduced into their longitudinal grooves. The element which in the guiding means is located at the bottom, or the pertaining body 10 rests on any desired counterbearing for instance the floor, while all other bodies 10 thereabove rest upon the respective lower body 10.

If roller 12 or a body 10 should become damaged, all bodies 10 can be pushed out of the guiding means, and after replacement or repair of the damaged body 10 or roller 12 can again be inserted in the manner described above.

It is, of course, to be understood that the present invention is, by no means, limited to the specific showing in the drawing, but also comprises any modifications within the scope of the appended claims.

What I claim is:

1. A guiding arrangement for vertical closure bodies, especially for roller doors, roller gates, and shutters, which includes in combination: guiding rail means of substantially U-shaped cross section with the inner surface thereof provided on both sides with groove means extending in the longitudinal direction of said rail means, multiple roller supporting means insertable from one end as well as removably arranged in said groove means capable of being assembled and disassembled in narrow space, and roller means rotatably supported by said roller supporting means at substantially the middle thereof with said roller means arranged thereon one above the other for rolling engagement with a closure body to be guided in said guiding rail means.

2. An arrangement in combination according to claim 1, in which said groove means are located on opposite sides of said rail means of U-shaped cross section.

3. An arrangement in combination according to claim 1, in which said guiding rail means comprise two guide rails each being of substantially U-shaped cross section with two legs defining a slot therebetween for receiving and guiding one side portion of a closure body to be guided by said rail means, and in which said groove means have a cross-shaped cross section with a first section having its longitudinal extension substantially transverse to the longitudinal extension of said slot for receiving said roller means, and with a second section substantially perpendicular to said first section for receiving said roller supporting means.

4. An arrangement in combination according to claim 3, in which said roller means include two rollers on opposite sides of said slot and slightly extending thereinto.

5. An arrangement in combination according to claim 1, in which said roller supporting means in each said groove means comprise a plurality of supporting members respectively arranged one above the other, the lowermost supporting member in each of said groove means being arranged for resting on a fixed support.

6. An arrangement in combination according to claim 5, in which said supporting members engage their groove means with slide fit.

7. An arrangement in combination according to claim 5, in which said supporting members are movable into their respective positions by gravity.

8. An arrangement in combination according to claim 1, in which said roller supporting means are bar-shaped and provided with apertures receiving said roller means, said roller means including roller axles journalled in said roller supporting means at opposite sides of said apertures.

* * * * *